United States Patent [19]

Radwanski et al.

[11] Patent Number: 4,950,531

[45] Date of Patent: Aug. 21, 1990

[54] NONWOVEN HYDRAULICALLY ENTANGLED NON-ELASTIC WEB AND METHOD OF FORMATION THEREOF

[75] Inventors: Fred R. Radwanski, Norcross, Ga.; Lloyd E. Trimble, Dustin, Okla.; Leon E. Chambers, Jr., Roswell, Ga.

[73] Assignee: Kimberly-Clark Corporation, Neenah, Wis.

[21] Appl. No.: 170,200

[22] Filed: Mar. 18, 1988

[51] Int. Cl.[5] ..... B32B 5/06

[52] U.S. Cl. ..... 428/284; 428/109; 428/286; 428/297; 428/298; 428/299; 428/903

[58] Field of Search ..... 28/104, 105; 428/903, 428/299, 297, 298, 288, 326, 255, 284, 286, 109

[56] References Cited

U.S. PATENT DOCUMENTS

| | | | |
|---|---|---|---|
| Re. 31,601 | 6/1984 | Ikeda et al. | 428/93 |
| 2,862,251 | 12/1958 | Kalwaites | 19/161 |
| 3,033,721 | 5/1962 | Kalwaites | 154/46 |
| 3,068,547 | 12/1962 | L'Hommedieu | 28/78 |
| 3,129,466 | 4/1964 | L'Hommedieu | 19/145 |
| 3,214,819 | 11/1965 | Guerin | 28/72.2 |
| 3,434,188 | 3/1969 | Summers | 28/72.2 |
| 3,485,706 | 12/1969 | Evans | 161/72 |
| 3,493,462 | 2/1970 | Bunting et al. | 161/169 |
| 3,494,821 | 2/1970 | Evans | 161/169 |
| 3,498,874 | 3/1970 | Evans | 161/109 |
| 3,508,308 | 4/1970 | Bunting et al. | 28/72.2 |
| 3,563,241 | 2/1971 | Evans | 128/284 |
| 3,620,903 | 11/1971 | Bunting et al. | 161/169 |
| 3,683,921 | 8/1972 | Brooks | 128/296 |
| 3,769,659 | 11/1973 | Kalwaites | 19/161 P |
| 3,800,364 | 4/1974 | Kalwaites | 19/161 P |
| 3,815,602 | 6/1974 | Johns et al. | 128/287 |
| 3,837,046 | 9/1974 | Kalwaites | 19/161 P |
| 4,041,203 | 8/1977 | Brock et al. | 428/157 |
| 4,152,480 | 5/1979 | Adachi et al. | 428/227 |
| 4,166,877 | 9/1979 | Brandon et al. | 428/221 |
| 4,190,695 | 2/1980 | Niederhauser | 428/234 |
| 4,251,581 | 2/1981 | Mimura et al. | 428/95 |
| 4,297,404 | 10/1981 | Nguyen | 428/85 |
| 4,302,495 | 11/1981 | Marra | 428/110 |
| 4,410,579 | 10/1983 | Johns | 428/131 |
| 4,426,420 | 1/1984 | Likhyani | 428/224 |
| 4,426,421 | 1/1984 | Nakamae | 428/234 |
| 4,442,161 | 4/1984 | Kirayoglu et al. | 428/219 |
| 4,476,186 | 10/1984 | Kato et al. | 428/290 |
| 4,514,455 | 4/1985 | Hwang | 428/198 |
| 4,532,173 | 7/1985 | Suzuki | 428/218 |
| 4,537,819 | 8/1985 | Schortmann et al. | 428/284 |
| 4,591,513 | 5/1986 | Suzuki et al. | 427/200 |
| 4,775,579 | 10/1988 | Hagy et al. | 428/284 |
| 4,808,467 | 2/1989 | Suskind et al. | 428/284 |
| 4,818,594 | 4/1989 | Albien et al. | 428/224 |

FOREIGN PATENT DOCUMENTS

| | | |
|---|---|---|
| 841938 | 5/1970 | Canada . |
| 1123589 | 5/1982 | Canada . |
| 108621 | 5/1984 | European Pat. Off. . |
| 128667 | 5/1984 | European Pat. Off. . |
| 120564 | 10/1984 | European Pat. Off. . |
| 127851 | 12/1984 | European Pat. Off. . |
| 1544165 | 4/1979 | United Kingdom . |
| 1550955 | 8/1979 | United Kingdom . |
| 1596718 | 8/1981 | United Kingdom . |
| 2085493 | 4/1982 | United Kingdom . |
| 2114054 | 8/1983 | United Kingdom . |
| 2114173 | 8/1983 | United Kingdom . |

OTHER PUBLICATIONS

"Du Pont Unveils Spunlaced Aramid Fibers for Wide--Ranging Industrial Applications", Nonwovens Markets, vol. 2, No. 23, pp. 4 and 5.

(List continued on next page.)

*Primary Examiner*—James J. Bell
*Attorney, Agent, or Firm*—Karl V. Sidor

[57] ABSTRACT

Composite nonwoven non-elastic web materials and methods of forming the same are disclosed. The composite nonwoven non-elastic web materials are formed by hydraulically entangling a laminate of (a) at least one layer of meltblown fibers and (b) at least one layer of nonwoven material. The nonwoven material can comprise at least one of pulp fibers, staple fibers, meltblown fibers and substantially continuous filaments. The nonwoven material can also be a net, foam, etc. Each of the meltblown fiber layer and the nonwoven material layer is preferably made of non-elastic material.

18 Claims, 4 Drawing Sheets

OTHER PUBLICATIONS

"The Outlook for Durable and Disposable Nonwoven Markets Through the 1980's", T. M. Holliday & Assocs. and R. G. Mansfield & Assoc., pp. 167–200.

"Spunlaced Products: Technology and End-Use Applications", E. I. duPont de Nemours & Company Inc.

"Burlington Tries Polyester/Cotton Spunlace", Nonwovens World, May–Jun. 1987, pp. 19 and 21.

"First Weaving, Then Knitting, Now Spunlaced Nonwovens", Nonwovens Industry, Jul. 1987, pp. 32, 34 and 35.

"Water Jet Entangled Nonwovens", John R. Starr, Insight 87, 9–21–87, pp. 1–20.

"Inda Looks Into the Future of Nonwovens Fabrics", INDA-TEC Nonwovens Technology Conference, Jun. 2–5, 1986, p. 5.

"Suominen Offers Wide Range of Spunlaced Nonwovens", European Disposables and Nonwovens Assoc., Newsletter Nov./Dec. 1986, vol. 12, No. 6.

"The Perfojet Entanglement Process", Andre Vuillaume, Nonwovens World, Feb. 1987, pp. 81–84.

"Progress with Sontara and Spunlaced Fabrics in Europe", Nonwoven Report, Jan. 1978, pp. 7 and 8.

"Composite of Synthetic-Fiber Web and Paper", Research Disclosure No. 09196/78, Jun. 1978.

"New Applications for Spunlaced Technology", H. H. Forsten Chemiefasern/Textilin dustrie, Mar. 1985, pp. 23 and 24.

NONWOVEN HYDRAULICALLY ENTANGLED NON-ELASTIC WEB AND METHOD OF FORMATION THEREOF

BACKGROUND OF THE INVENTION

The present invention relates to nonwoven material and, more particularly, to nonwoven fibrous hydraulically entangled web material, wherein the nonwoven hydraulically entangled material is a hydraulically entangled non-elastic web of at least one layer of meltblown fibers and at least one layer of nonwoven, e.g., fibrous, material such as pulp fibers, staple fibers, meltblown fibers, continuous filaments, nets, foams, etc. Such material has applications for wipes, tissues, bibs, napkins, cover-stock or protective clothing substrates, diapers, feminine napkins, laminates and medical fabrics, among other uses.

Moreover, the present invention relates to methods of forming such nonwoven non-elastic material by hydraulic entangling techniques.

It has been desired to provide a nonwoven material having improved hand and drape without sacrificing strength and integrity.

U.S. Pat. No. 3,485,706 to Evans, the contents of which are incorporated herein by reference, discloses a textile-like nonwoven fabric and a process and apparatus for its production, wherein the fabric has fibers randomly entangled with each other in a repeating pattern of localized entangled regions interconnected by fibers extending between adjacent entangled regions. The process disclosed in this patent involves supporting a layer of fibrous material on an apertured patterning member for treatment, jetting liquid supplied at pressures of at least 200 pounds per square inch (psi) gage to form streams having over 23,000 energy flux in foot-poundals/inch$^2$.seconds at the treatment distance, and traversing the supporting layer of fibrous material with the streams to entangle fibers in a pattern determined by the supporting member, using a sufficient amount of treatment to produce uniformly patterned fabric. The initial material is disclosed to consist of any web, mat, batt or the like of loose fibers disposed in random relationship with one another or in any degree of alignment.

U.S. Pat. No. Re. 31,601 to Ikeda et al discloses a fabric, useful as a substratum for artificial leather, which comprises a woven or knitted fabric constituent and a nonwoven fabric constituent. The nonwoven fabric constituent consists of numerous extremely fine individual fibers which have an average diameter of 0.1 to 6.0 microns and are randomly distributed and entangled with each other to form a body of nonwoven fabric. The nonwoven fabric constituent and the woven or knitted fabric constituent are superimposed and bonded together, to form a body of composite fabric, in such a manner that a portion of the extremely fine individual fibers and the nonwoven fabric constituent penetrate into the inside of the woven or knitted fabric constituent and are entangled with a portion of the fibers therein. The composite fabric is disclosed to be produced by superimposing the two fabric constituents on each other and jetting numerous fluid streams ejected under a pressure of from 15 to 100 kg/cm$^2$ toward the surface of the fibrous web constituent. This patent discloses that the extremely fine fibers can be produced by using any of the conventional fiber-producing methods, preferably a meltblown method.

U.S. Pat. No. 4,190,695 to Niederhauser discloses lightweight composite fabrics suitable for general purpose wearing apparel, produced by a hydraulic needling process from short staple fibers and a substrate of continuous filaments formed into an ordered cross-directional array, the individual continuous filaments being interpenetrated by the short staple fibers and locked in place by the high frequency of staple fiber reversals. The formed composite fabrics can retain the staple fibers during laundering, and have comparable cover and fabric aesthetics to woven materials of higher basis weight.

U.S. Pat. No. 4,426,421 to Nakamae et al discloses a multi-layer composite sheet useful as a substrate for artificial leather, comprising at least three fibrous layers, namely, a superficial layer consisting of spun-laid extremely fine fibers entangled with each other, thereby forming a body of a nonwoven fibrous layer; an intermediate layer consisting of synthetic staple fibers entangled with each other to form a body of a nonwoven fibrous layer; and a base layer consisting of a woven or knitted fabric. The composite sheet is disclosed to be prepared by superimposing the layers together in the aforementioned order and, then, incorporating them together to form a body of composite sheet by means of a needle-punching or water-stream-ejecting under a high pressure. This patent discloses that the spun-laid extremely fine fibers can be produced by the meltblown method.

U.S. Pat. No. 4,442,161 to Kirayoglu et al discloses a spunlaced (hydraulically entangled) nonwoven fabric and a process for producing the fabric, wherein an assembly consisting essentially of wood pulp and synthetic organic fibers is treated, while on a supporting member, with fine columnar jets of water. This patent discloses it is preferred that the synthetic organic fibers be in the form of continuous filament nonwoven sheets and that the wood pulp fibers be in the form of paper sheets.

U.S. Pat. No. 4,476,186 to Kato et al discloses an entangled nonwoven fabric which includes a portion (a) comprised of fiber bundles of ultrafine fibers having a size not greater than about 0.5 denier, which bundles are entangled with one another, and a portion (b) comprised of ultrafine fibers to fine bundles of ultrafine fibers branching from the ultrafine bundles, which ultrafine bundles and fine bundles of ultrafine fibers are entangled with one another, and in which both portions (a) and (b) are non-uniformly distributed in the direction of fabric thickness.

U.S. Pat. No. 4,041,203 to Brock et al discloses a nonwoven fabric-like material comprising an integrated mat of generally discontinuous, thermoplastic polymeric micro-fibers and a web of substantially continuous and randomly deposited, molecularly oriented filaments of a thermoplastic polymer. The polymeric microfibers have an average fiber diameter of up to about 10 microns while the average diameter of filaments in the continuous filament web is in excess of about 12 microns. Attachment between the micro-fiber mat and continuous filament web is achieved at intermittent discrete regions in a manner so as to integrate the continuous filament web into an effective load-bearing constituent of the material. It is preferred that the discrete bond regions be formed by the application of heat and pressure at the intermittent areas. Other methods of ply attachment such as the use of independently applied adhesives or mechanically interlocking the fibers such as by needling techniques or the like can also be used. Other fabrics employing meltblown microfibers are disclosed in U.S. Pat. No. 3,916,447 to Thompson and U.S. Pat. No. 4,379,192 to Wahlquist et al.

U.S. Pat. No. 4,514,455 to Hwang discloses a composite nonwoven fabric which comprises a batt of crimped polyester staple fibers and a bonded sheet of substantially continuous polyester filaments. The batt and the sheet are in surface contact with each other and are attached to each other by a series of parallel seams having a spacing of at least 1.7 cm, and preferably no greater than 5 cm, between successive seams. In one embodiment of Hwang, the seams are jet tracks which are a result of hydraulic stitching.

However, it is desired to provide a nonwoven web material having improved hand and drape and in which the strength (wet and dry) of the web remains high. Moreover, it is desired to provide a cloth-like fabric which can have barrier properties and high strength. Furthermore, it is desired to provide a process for producing such material which allows for control of other product attributes, such as absorbency, wet strength, durability, low linting, etc.

SUMMARY OF THE INVENTION

Accordingly, it is an object of the present invention to provide a nonwoven non-elastic web material having good hand and drape, and methods for forming such material.

It is a further object of the present invention to provide a nonwoven non-elastic web material having high web strength, integrity and low linting, and methods of forming such material.

It is an additional object of the present invention to provide a nonwoven non-elastic web material having cloth-like characteristics and barrier properties, and methods of forming such material.

The present invention achieves each of the above objects by providing a composite nonwoven non-elastic web material formed by hydraulically entangling a laminate of (1) at least one layer of meltblown fibers and (2) at least one layer of nonwoven, e.g., fibrous, material such as a layer of at least one of pulp fibers, staple fibers, meltblown fibers, continuous filaments, nets, foams, etc., so as to provide a nonwoven non-elastic web material. Preferably, the meltblown fiber layer and the nonwoven material layer are each made of non-elastic material.

The use of meltblown fibers as part of the structure (e.g., laminate) subjected to hydraulic entangling facilitates entanglement of the various fibers and/or filaments. This results in a higher degree of entanglement and allows the use of a wider variety of other fibrous material in the laminate. Moreover, the use of meltblown fibers can decrease the amount of energy needed to hydraulically entangle the laminate. In hydraulic entangle bonding technology, sometimes referred to as "spunlace", typically a sufficient number of fibers with loose ends (e.g., staple fibers and wood fibers), small diameters and high fiber mobility are incorporated in the fibrous webs to wrap and entangle around fiber filament, foam, net, etc., cross-over points. Without such fibers, bonding of the web is quite poor. Continuous large diameter filaments which have no loose ends and are less mobile have normally been considered poor fibers for entangling. However, meltblown fibers have been found to be effective for wrapping and entangling or intertwining. This is due to the fibers having small diameters and a high surface area, and the fact that when a high enough energy flux is delivered from the jets, fibers break up, are mobilized and entangle other fibers. This phenomenon occurs regardless of whether meltblown fibers are in the aforementioned layered forms or in admixture forms.

The use of meltblown fibers (e.g., microfibers) provides an improved product in that the intertwining among the meltblown fibers and other, e.g., fibrous, material in the laminate is improved. Thus, due to the relatively great length and relatively small thickness of the meltblown fibers, entangling of the meltblown fibers around the other material in the laminate is enhanced. Moreover, the meltblown fibers have a relatively high surface area, small diameters and are sufficient distances apart from one another to allow other fibrous material in the laminate to freely move and wrap around and within the meltblown fibers. In addition, because the meltblown fibers are numerous and have a relatively high surface area, small diameter and are nearly continuous, such fibers are excellent for anchoring (bonding) loose fibers (e.g., wood fibers and staple fibers) to them. Anchoring or laminating such fibers to meltblown fibers requires relatively low amounts of energy to entangle.

The use of hydraulic entangling techniques, to mechanically entangle (e.g., mechanically bond) the fibrous material, rather than using only other bonding techniques, including other mechanical entangling techniques, provides a composite nonwoven fibrous web material having increased strength, integrity and hand and drape, and allows for better control of other product attributes, such as absorbency, wet strength, etc.

DETAILED DESCRIPTION OF THE INVENTION

While the invention will be described in connection with the specific and preferred embodiments, it will be understood that it is not intended to limit the invention to those embodiments. On the contrary, it is intended to cover all alterations, modifications and equivalents as may be included within the spirit and scope of the invention as defined by the appended claims.

The present invention contemplates a composite nonwoven non-elastic web of a hydraulically entangled laminate, and a method of forming the same, which involves processing a laminate of at least one layer of meltblown fibers and at least one layer of nonwoven material. The laminate is hydraulically entangled, that is, a plurality of high pressure liquid columnar streams are jetted toward a surface of the laminate, thereby mechanically entangling and intertwining the meltblown fibers and the nonwoven material of the laminate so as to provide a nonwoven non-elastic web material. Preferably each of the meltblown fiber layer and the nonwoven material layer is made of non-elastic material.

By a nonwoven layer, we mean a layer of material which does not embody a regular pattern of mechanically interengaged strands, strand portions or strand-like strips, i.e., is not woven or knitted.

The fibers or filaments can be in the form of, e.g., webs, batts, loose fibers, etc. The laminate can include other, e.g., fibrous, layers.

Figure 1:
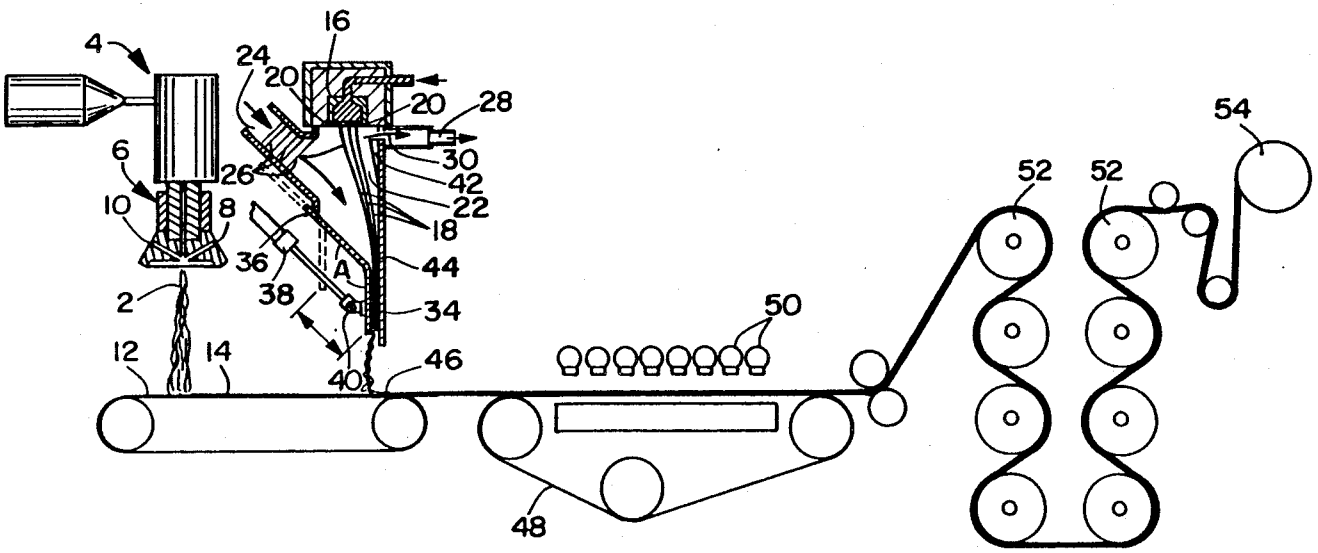
FIG. 1 is a schematic view of an apparatus for forming a composite nonwoven non-elastic web material of the present invention.

FIG. 1 schematically shows an apparatus for producing the composite nonwoven web material of the present invention.

A gas stream 2 of meltblown microfibers, preferably non-elastic meltblown microfibers, is formed by known meltblowing techniques on conventional meltblowing apparatus generally designated by reference numeral 4, e.g., as discussed in U.S. Pat. No. 3,849,241 to Buntin et al and U.S. Pat. No. 4,048,364 to Harding et al, the contents of each of which are incorporated herein by reference. Basically, the method of formation involves extruding a molten polymeric material through a die head generally designated by the reference numeral 6 into fine streams and attenuating the streams by converging flows of high velocity, heated fluid (usually air) supplied from nozzles 8 and 10 to break the polymer streams into fibers of relatively small diameter. The die head preferably includes at least one straight row of extrusion apertures. The fibers can be microfibers or macrofibers depending on the degree of attenuation. Microfibers are subject to a relatively greater attenuation and can have a diameter of up to about 20 microns, but are generally approximately 2 to 12 microns in diameter. Macrofibers generally have a larger diameter, i.e., greater than about 20 microns, e.g., 20–100 microns, usually about 50 microns. The gas stream 2 is collected on, e g., belt 12 to form meltblown web 14.

In general, any thermoformable polymeric material, especially non-elastic thermoformable material, is useful in forming meltblown fibers such as those disclosed in the aforementioned Buntin et al patents. For example, polyolefins such as polypropylene and polyethylene, polyamides and polyesters such as polyethylene terephthalate can be used, as disclosed in U.S. Pat. No. 4,100,324, the contents of which are incorporated herein by reference. Polypropylene, polyethylene, polyethylene terephthalate, polybutylene terephthalate and polyvinyl chloride are preferred non-elastic materials. Non-elastic polymeric material, e.g., a polyolefin, is most preferred for forming the meltblown fibers in the present invention. Copolymers of the foregoing materials may also be used.

The meltblown layer 14 can be laminated with at least one nonwoven, preferably non-elastic, layer. The latter layer or layers can be previously formed or can be formed directly on the meltblown layer 14 via various processes, e.g., dry or wet forming, carding, etc.

The nonwoven, preferably non-elastic, layer can be made of substantially continuous filaments. The substantially continuous filaments are preferably large diameter continuous filaments such as unbonded meltspun (spunbond) filaments (e.g., meltspun polypropylene or polyester), nylon netting, scrims and yarns. An unbonded meltspun, such as a completely unbonded, e.g., 0.5 oz/yd$^2$, web of meltspun polypropylene filaments having an average diameter of about 20 microns, is particularly preferable.

Meltspun filaments can be produced by known methods and apparatus such as disclosed in U.S. Pat. No. 4,340,567 to Appel, the contents of which are incorporated herein by reference. The meltspun filament layer and the meltblown layer can be formed separately and placed adjacent one another before hydraulic entanglement or one layer can be formed directly on the other layer. For example, the meltspun filaments can be formed directly on the meltblown layer, as shown in FIG. 1. As shown schematically in this figure, a spinnerette 16 may be of conventional design and arranged to provide extrusion of filaments 18 in one or more rows of orifices 20 across the width of the device into a quench chamber 22. Immediately after extrusion through the orifices 20, acceleration of the strand movement occurs due to tension in each filament generated by the aerodynamic drawing means. The filaments simultaneously begin to cool from contact with the quench fluid which is supplied through inlet 24 and one or more screens 26 in a direction preferably at an angle having the major velocity component in the direction toward the nozzle entrance. The quench fluid may be any of a wide variety of gases as will be apparent to those skilled in the art, but air is preferred for economy. The quench fluid is introduced at a temperature to provide for controlled cooling of the filaments. The exhaust air fraction exiting at 28 from ports 30 affects how fast quenching of the filaments takes place. For example, a higher flow rate of exhaust fluid results in more being pulled through the filaments which cools the filaments faster and increases the filament denier. As quenching is completed, the filament curtain is directed through a smoothly narrowing lower end of the quenching chamber into nozzle 32 where the air attains a velocity of about 150 to 800 feet per second. The drawing nozzle is full machine width and preferably formed by a stationary wall 34 and a movable wall 36 spanning the width of the machine. Some arrangement for adjusting the relative locations of sides 34 and 36 is preferably provided such as piston 38 fixed to side 36 at 40. In a particularly preferred embodiment, some means such as fins 42 are provided to prevent a turbulent eddy zone from forming. It is also preferred that the entrance to the nozzle formed by side 36 be smooth at corner 44 and at an angle a of at least about 135° to reduce filament breakage. After exiting from the nozzle, the filaments may be collected directly on the meltblown layer 14 to form laminate 46.

When a laminate of a meltblown fiber layer and meltspun filament layer is hydraulically entangled, the web remains basically two-sided, but a sufficient amount of meltblown fibers break from the meltblown web and loop around the larger meltspun filament layers to bond the entire structure. While a small amount of entanglement also occurs between meltspun filaments, most of the bonding is due to meltblown fibers entangling around and within meltspun filaments.

If added strength is desired, the hydraulically entangled laminate or admixture can undergo additional bonding (e.g., chemical or thermal). In addition, bicomponent and shaped fibers, particulates (e.g., as part of the meltblown layer), etc., can further be utilized to engineer a wide variety of unique cloth-like fabrics.

A fabric with cloth-like hand, barrier properties, low linting and high strength can also be obtained by hydraulically entangling a laminate of a sheet of cellulose (e.g., wood or vegetable pulp) fibers and web of thermoplastic meltblown fibers. After being mechanically softened, the hand of the materials can be vastly improved. In addition, barrier properties and selective absorbency can be incorporated into the fabric. Such fabrics are very similar, at low basis weights, to pulp coform. Also, the versatility of the meltblown process (i.e., adjustable porosity/fiber size), paper-making techniques (e.g., wet forming, softening, sizing, etc.) and the hydraulic entangling process enable other beneficial attributes to be achieved, such as improved absorbency, abrasion resistance, wet strength and two-sided absorbency (oil/water). Terrace Bay Long Lac-19 wood pulp, which is a bleached Northern softwood kraft pulp composed of fiber having an average length of 2.6 millimeters, and Southern pine, e.g., K-C Coosa CR-55, with an average length of 2.5 millimeters are particularly preferred cellulose materials. Cotton such as cotton linters and refined cotton can also be used.

Cellulose fibers can also be hydraulically entangled into a meltspun/meltblown laminate. For example, a sheet of wood pulp fibers, e.g., ECH Croften kraft (70% Western red cedar/30% hemlock), can be hydraulically entangled into a laminate of meltspun polypropylene filaments with an average denier of 1.6 d.p.f. and meltblown polypropylene fibers with an average size of 2–12 microns.

A layer of staple fibers, e.g., wool, cotton, rayon and polyethylene can, e.g., be layered on an already formed meltblown web. The staple fibers can be in the form of, e.g., webs, batts, loose fibers, etc. Examples of various materials and methods of forming staple fiber layers and hydraulically entangling the same are disclosed in the aforementioned U.S. Pat. No. 3,485,706 to Evans. The layered composite can be hydraulically entangled at operating pressures up to 2,000 psi. The pattern of entangling can be adjusted by changing the carrying wire geometry to achieve the desired strength and aesthetics. If a polyester meltblown is used as a substrate for such a structure, a durable fabric which can withstand laundering requirements can be produced.

Another meltblown web can be laminated with the already formed meltblown web. In such a case, the apparatus for forming meltspun filaments shown in FIG. 1 can be replaced with another conventional meltblowing apparatus such as that generally designated by the reference numeral 4 in FIG. 1.

Other nonwoven layers such as nets, foams, etc., as well as films, e.g., extruded films, or coatings such as latex, can also be laminated with the already formed meltblown web.

It is not necessary that the web or the layers thereof (e.g., the meltblown fibers or the meltspun filaments) be totally unbonded when passed into the hydraulic entangling step. The main criterion is that, during hydraulic entangling, sufficient "free" fibers (fibers which are sufficiently mobile) are generated to provide the desired degree of entanglement. Thus, such sufficient mobility can possibly be provided by the force of the jets during the hydraulic entangling, if, e.g., the meltblown fibers have not been agglomerated too much in the melt-blowing process. The degree of agglomeration is affected by process parameters, e.g., extruding temperature, attenuation air temperature, quench air or water temperature, forming distance, etc. Excessive fiber bonding can be avoided by rapidly quenching the gas stream of fibers by spraying a liquid thereon as disclosed in U.S. Pat. No. 3,959,421 to Weber et al, the contents of which are incorporated herein by reference. Alternatively, the web can be mechanically stretched and worked (manipulated), e.g., by using grooved nips or protuberances, prior to the hydraulic entangling to sufficiently unbond the fibers.

It will be noted that the laminate or mixture subjected to hydraulic entanglement can be completely nonwoven. That is, it need not contain a woven or knitted constituent.

Suitable hydraulic entangling techniques are disclosed in the aforementioned Evans patent and an article by Honeycomb Systems, Inc., Biddeford, Maine, entitled "Rotary Hydraulic Entanglement of Nonwovens," reprinted from *INSIGHT* 86 *INTERNATIONAL ADVANCED FORMING/BONDING CONFERENCE,* the contents of which are incorporated herein by reference. For example, hydraulic entangling involves treatment of the laminate or web 46, while supported on an apertured support 48, with streams of liquid from jet devices 50. The support 48 can be a mesh screen or forming wires. The support 48 can also have a pattern so as to form a nonwoven material with such pattern. The apparatus for hydraulic entanglement can be conventional apparatus, such as described in the a forementioned U.S. Pat. No. 3,485,706. On such an apparatus, fiber entanglement is accomplished by jetting liquid supplied at pressures, e.g., of at least about 200 psi, to form fine, essentially columnar, liquid streams toward the surface of the supported laminate (or mixture). The supported laminate (or mixture) is traversed with the streams until the fibers are randomly entangled and interconnected. The laminate (or mixture) can be passed through the hydraulic entangling apparatus a number of times on one or both sides. The liquid can be supplied at pressures of from about 100 to 3,000 psi. The orifices which produce the columnar liquid streams can have typical diameters known in the art, e.g., 0.005 inch, and can be arranged in one or more rows with any number of orifices, e.g., 40, in each row. Various techniques for hydraulic entangling are described in the aforementioned U.S. Pat. No. 3,485,706, and this patent can be referred to in connection with such techniques.

After the laminate (or mixture) has been hydraulically entangled, it can be dried by a through drier and/or the drying cans 52 and wound on winder 54. Optionally, after hydraulic entanglement, the web can be further treated, such as by thermal bonding, coating, softening, etc.

Figure 2A:
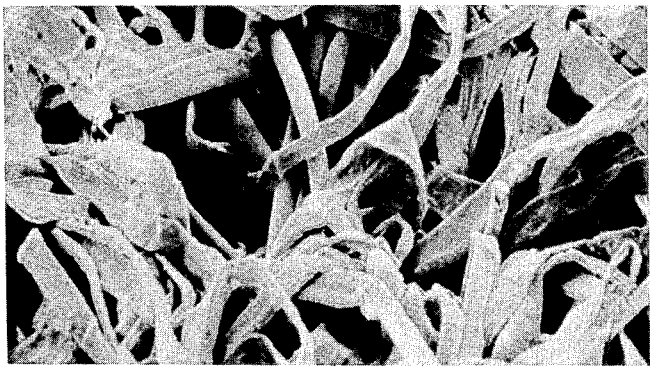
FIGS. 2A and 2B are photomicrographs (157× and 80× magnification, respectively) of respective sides of one example of a composite nonwoven non-elastic material of the present invention.
Figure 2B:
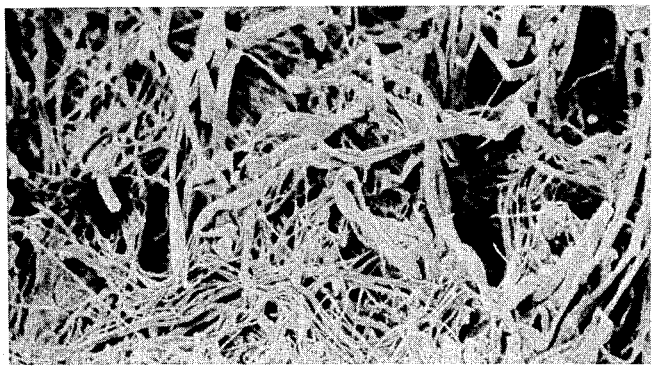

FIGS. 2A and 2B are photomicrographs of a wood fiber/spunbond/meltblown laminate which has been hydraulically entangled at a line speed of 23 fpm at 600, 600, 600 psi from the wood fiber side on a 100×92 mesh. In particular, the laminate was made of 34 gsm red cedar, 14 gsm spunbond polypropylene and 14 gsm meltblown polypropylene. The wood fiber side is shown face up in FIG. 2A and the meltblown side is shown face up in FIG. 2B.

Figure 3A:
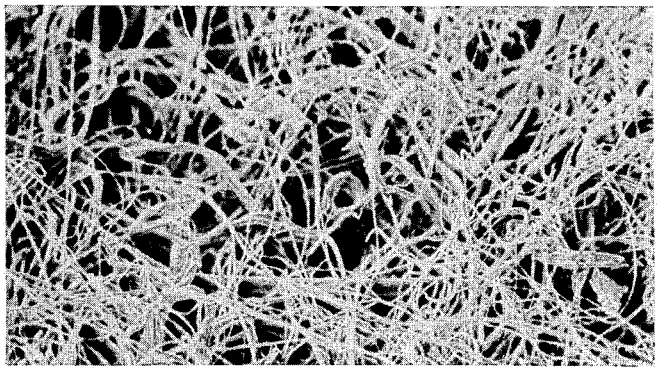
FIGS. 3A and 3B are photomicrographs (82× and 88× magnification, respectively) of respective sides of another example of a composite nonwoven non-elastic material of the present invention.
Figure 3B:
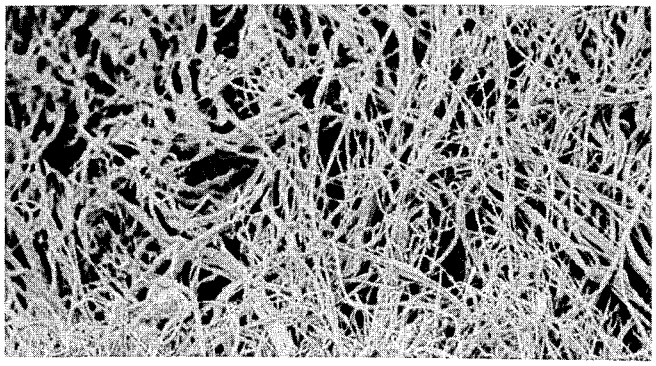

FIGS. 3A and 3B are photomicrographs of a meltblown/spunbond laminate which has been hydraulically entangled at a line speed of 23 fpm at 200, 400, 800, 1200, 1200, 1200 psi from the meltblown side on a 100×92 mesh. In particular, the laminate was made of 17 gsm meltblown polypropylene and 17 gsm spunbond polypropylene. The meltblown side is shown face up in FIG. 3A and the spunbond side is face up in FIG. 3B.

Figure 4A:
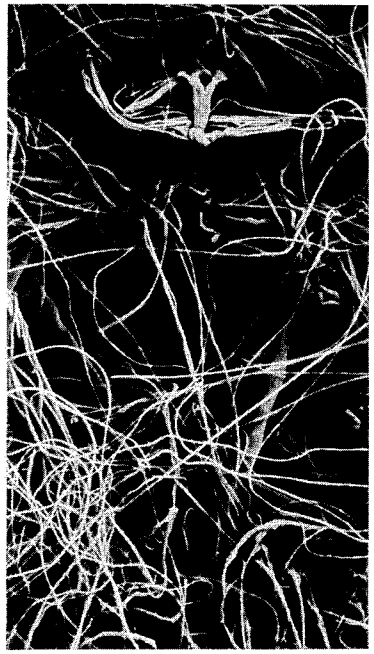
FIGS. 4A and 4B are photomicrographs (85× and 85× magnification, respectively) of still another example of a composite nonwoven non-elastic material of the present invention.
Figure 4B:
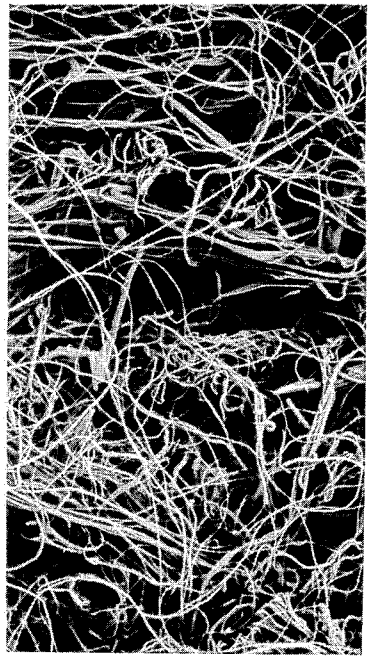

FIGS. 4A and 4B are photomicrographs of a meltblown/spunbond/meltblown laminate which has been hydraulically entangled at a line speed of 23 fpm three times on each side at 700 psi on a 100×92 mesh as described in Example 3. The first side entangled is shown face up in FIG. 4A and the last side entangled is face up in FIG. 4B.

Various examples of processing conditions will be set forth as illustrative of the present invention. Of course, such examples are illustrative and are not limiting. For example, commercial line speeds are expected to be higher, e.g., 400 fpm or above. Based on sample work, line speeds of, e.g., 1,000 or 2,000 fpm may be possible.

In the following examples, the specified materials were hydraulically entangled under the specified conditions. The hydraulic entangling was carried out using hydraulic entangling equipment similar to conventional equipment, having jets with 0.005 inch orifices, 40 orifices per inch, and with one row of orifices. The percentages given refer to weight percents.

Example 1

A laminate of wood fiber/meltblown fiber/wood fiber was provided. Specifically, the laminate contained a layer of wood fiber containing 60% Terrace Bay Long Lac-19 wood pulp and 40% eucalyptus (the layer having a basis weight of 15 gsm), a layer of meltblown polypropylene (basis weight of 10 gsm) and a layer of wood fiber containing 60% Terrace Bay Long Lac-19 wood pulp and 40% eucalyptus (basis weight of 15 gsm). The estimated basis weight of this laminate was 45 gsm. The laminate was hydraulically entangled at a processing speed of 23 fpm by making three passes through the equipment on each side at 400 psi. A 100×92 wire mesh was used as the support during the hydraulic entanglement.

Example 2

A staple fiber/meltblown fiber/staple fiber laminate was hydraulically entangled. Specifically, a first layer of rayon staple fibers (basis weight of 14 gsm) was laminated with a second layer of meltblown polypropylene fibers (basis weight of 10 gsm) and a third layer of polypropylene staple fibers (basis weight of 15 gsm). The laminate had an estimated basis weight of 38 gsm. Using a processing speed of 23 fpm and a 100×92 wire mesh support, the laminate was hydraulically entangled three times on each side at 600 psi with the rayon side being entangled first.

Example 3

A meltblown polypropylene/spunbond polypropylene/meltblown polypropylene laminate was hydraulically entangled. Specifically, a laminate of meltblown polypropylene (basis weight of 10 gsm), spunbond polypropylene (basis weight of 10 gsm) and meltblown polypropylene (basis weight of 10 gsm) having an estimated basis weight of 30 gsm was hydraulically entangled at a processing speed of 23 fpm using a 100×92 wire mesh support. The laminate was entangled three times on each side at 700 psi.

Example 4

A wood fiber/spunbond polypropylene/meltblown polypropylene laminate was hydraulically entangled. Specifically, a laminate of Terrace Bay Long Lac-19 (basis weight of 20 gsm), spunbond polypropylene (basis weight of 10 gsm) and meltblown polypropylene (basis weight of 10 gsm) having an estimated basis weight of 40 gsm was hydraulically entangled at a processing speed of 23 fpm on a 100×92 wire mesh support. The laminate was entangled on the first side only at 500 psi for three passes.

Physical properties of the materials of Examples 1 through 4 were measured in the following manner:

The bulk was measured using an Ames bulk or thickness tester (or equivalent) available in the art. The bulk was measured to the nearest 0.001 inch.

The basis weight and MD and CD grab tensiles were measured in accordance with Federal Test Method Standard No. 191A (Methods 5041 and 5100, respectively).

The absorbency rate was measured on the basis of the number of seconds to completely wet each sample in a constant temperature water bath and oil bath.

A "cup crush" test was conducted to determine the softness, i.e., hand and drape, of the samples. This test measures the amount of energy required to push, with a foot or plunger, the fabric which has been pre-seated over a cylinder or "cup." The lower the peak load of a sample in this test, the softer, or more flexible, the sample. Values below 100 to 150 grams correspond to what is considered a "soft" material. The results of these tests are shown in Table 1.

The Frazier test was used to measure the permeability of the samples to air in accordance with Federal Test Method Standard No. 191A (Method 5450).

In this Table, for comparative purposes, are set forth physical properties of two known hydraulically entangled nonwoven fibrous materials, Sontara® 8005, a spunlaced fabric of 100% polyester staple fibers, 1.35 d.p.f.×¾", from E.I. DuPont de Nemours and Company, and Optima®, a wood pulp-polyester converted product from American Hospital Supply Corp.

TABLE 1

| Example | Basis Weight (gsm) | Bulk (inches) | MD GRAB TENSILES Peak Energy (in-lb) | Peak Load (lbs.) | Peak Elongation (in) | Peak Strain (%) | Fail Energy (in-lb) |
|---|---|---|---|---|---|---|---|
| 1 | 44 | .027 | 0.8 | 1.6 | 0.8 | 26.3 | 1.6 |
| 2 | 43 | .028 | 5.4 | 7.0 | 1.7 | 56.7 | 11.9 |
| 3 | 33 | .040 | 24.1 | 11.4 | 4.0 | 132.7 | 42.6 |
| 4 | 41 | .025 | 27.5 | 14.4 | 3.3 | 108.7 | 46.5 |
| Sontara® 8005 | 65 | .020 | 20.1 | 42.3 | 1.0 | 34.6 | 40.4 |
| Optima® | 72 | .020 | 12.9 | 26.3 | 1.0 | 33.8 | 35.1 |

| Example | GRAB TENSILES Peak Energy (in-lb) | Peak Load (lbs.) | Peak Elongation (in) | Peak Strain (%) | Fail Energy (in-lb) | Water Sink (sec) | Oil Sink (sec) | Frazier Test (CFM/ft$^2$ @ 0.5" $H_2O$) | Cup Crush Peak Load (grams) | Total Energy (grams/mm) |
|---|---|---|---|---|---|---|---|---|---|---|
| 1 | 1.1 | 1.6 | 1.3 | 43.2 | 2.3 | 1.2/<.1* | 0.7 | 112 | — | — |
| 2 | 3.4 | 2.7 | 2.8 | 92.8 | 6.4 | | | 179 | 32 | 552 |
| 3 | 26.4 | 10.8 | 4.2 | 139.2 | 46.2 | | | 188 | 30 | 423 |

TABLE 1-continued

| | | | | | | | | | | |
|---|---|---|---|---|---|---|---|---|---|---|
| 4 | 23.3 | 12.8 | 3.4 | 112.5 | 38.2 | | | 228 | — | — |
| Sontara ® 8005 | 23.0 | 18.5 | 4.0 | 134.3 | 39.8 | | | | | |
| Optima ® | 16.6 | 22.1 | 2.1 | 71.0 | 32.0 | 60+ | 60+ | 85 | 196 | 3522 |

*Surfactant treated with Rohm & Haas Triton X-102

As can be seen in the foregoing Table 1, nonwoven fibrous material within the scope of the present invention has a superior combination of properties of strength, drape and hand. Use of microfibers, as compared to carded webs or staple fibers, etc., gives a "fuzzy surface" thereby producing a softer-feeling product.

The material is also softer (less rough) than spunbond or other bonded (adhesive, thermal, etc.) material. Use of meltblown fibers produces a material having more covering power than with other types of webs.

The present invention provides a web which is very useful for manufacturing disposable material such as work wear, medical fabrics,, disposable table linens, etc. The material has high abrasion resistance. Because of Z-direction fibers, it also has good transfer (e.g., liquid transfer) properties, and has good prospects for absorbents. The material may also be used for diaper covers because it has a cottony feel.

The use of spunbond fibers produces a product which has very high strength. Cellulose/meltblown hydraulically entangled laminates have much higher strength than tissue. The hydraulically entangled product has isotropic elongation (extensibility), not only elongation in the CD direction. The hydraulically entangled products have good hand.

This case is one of a group of cases which are being filed on the same date. The group includes (1) "Nonwoven Fibrous Hydraulically Entangled Elastic Coform Material And Method Of Formation Thereof, " F. Radwanski, et al., application Ser. No. 07/170,196; (2) "Nonwoven Fibrous Hydraulically Entangled Non-Elastic Coform Material And Method Of Formation Thereof," F. Radwanski et al application Ser. No. 07/170,208; (3) "Hydraulically Entangled Nonwoven Elastomeric Web And Method Of Forming The Same," F. Radwanski et al application Ser. No. 07/170,209; (4) "Nonwoven Hydraulically Entangled Non-Elastic Web And Method Of Formation Thereof," F. Radwanski et al application Ser. No. 07/170,200; and (5) "Nonwoven Material Subjected To Hydraulic Jet Treatment In Spots, And Method And Apparatus For Producing The Same," F. Radwanski application Ser. No. 07/170,193. The contents of the other applications in this group, other than the present application, are incorporated herein by reference.

While we have shown and described several embodiments in accordance with the present invention, it is understood that the same is not limited thereto, but is susceptible of numerous changes and modifications as are known to one having ordinary skill in the art, and we therefor do not wish to be limited to the details shown and described herein, but intend to cover all such modifications as are encompassed by the scope of the appended claims.

What is claimed is:

1. A composite nonwoven non-elastic web material formed by hydraulically entangling a laminate comprising (a) at least one layer of meltblown fibers and (b) at least one layer of nonwoven material, said hydraulic entangling causing the entanglement and intertwining of said meltblown fibers and said nonwoven material so as to provide a nonwoven non-elastic web material.

2. A composite nonwoven non-elastic web material according to claim 1, wherein said laminate consists essentially of (a) at least one layer of meltblown fibers and (b) at least one layer of nonwoven material.

3. A composite nonwoven non-elastic web material according to claim 1, wherein said meltblown fibers are polypropylene meltblown fibers.

4. A composite nonwoven non-elastic web material according to claim 1, wherein said nonwoven material comprises substantially continuous non-elastic filaments.

5. A composite nonwoven non-elastic web material according to claim 4, wherein said substantially continuous non-plastic filaments are spunbond filaments.

6. A composite nonwoven non-elastic web material according to claim 5, wherein said spunbond filaments are formed of a material selected from the group consisting of polypropylene and polyester.

7. A composite nonwoven non-elastic web material according to claim 1, wherein said nonwoven material comprises non-elastic pulp fibers.

8. A composite nonwoven non-elastic web material according to claim 7, wherein said non-elastic pulp fibers are cellulose pulp fibers.

9. A composite nonwoven non-elastic web material according to claim 7, wherein said non-elastic pulp fibers are wood pulp fibers.

10. A composite nonwoven non-elastic web material according to claim 1, wherein said, nonwoven material comprises non-elastic staple fibers.

11. A composite nonwoven non-elastic web material according to claim 10, wherein said non-elastic staple fibers are synthetic staple fibers.

12. A composite nonwoven non-elastic web material according to claim 11, wherein said synthetic staple fibers are made of a material selected from the group consisting of rayon and polypropylene.

13. A composite nonwoven non-elastic web material according to claim 1, wherein said nonwoven material comprises non-elastic meltblown fibers.

14. A composite nonwoven non-elastic web material according to claim 13, wherein said non-elastic meltblown fibers are meltblown microfibers.

15. A composite nonwoven non-elastic web material according to claim 13, wherein said non-elastic meltblown fibers are meltblown macrofibers.

16. A composite nonwoven non-elastic web material according to claim 1, wherein said nonwoven material comprises a non-elastic net.

17. A composite nonwoven non-elastic web material according to claim 1, wherein said nonwoven material comprises a foam material.

18. A composite nonwoven non-elastic web material according to claim 1, wherein each of said meltblown fibers and said nonwoven material consists essentially of non-elastic material.

* * * * *

UNITED STATES PATENT AND TRADEMARK OFFICE

CERTIFICATE OF CORRECTION

PATENT NO. : 4,950,531
DATED : August 21, 1990
INVENTOR(S) : Fred R. Radwanski, Lloyd E. Trimble and Leon E. Chambers, Jr.

It is certified that error appears in the above-identified patent and that said Letters Patent is hereby corrected as shown below:

Column 1, line 38 "seconds" should read -- second --

Table 1 (cont'd), Column Peakload, Line Sontara 8005 "---" should read -- 89

Table 1 (cont'd), Column Total Energy, Line Sontara 8005 "---" should read -- 1537

Signed and Sealed this

Twelfth Day of May, 1992

*Attest:*

DOUGLAS B. COMER

*Attesting Officer*

*Acting Commissioner of Patents and Trademarks*